United States Patent [19]

Hollis

[11] 3,930,677

[45] Jan. 6, 1976

[54] LATCH MECHANISM FOR CLOSURE MEMBER

[75] Inventor: Lyn C. Hollis, Pontiac, Mich.

[73] Assignee: General Motors Corporation, Detroit, Mich.

[22] Filed: Nov. 21, 1974

[21] Appl. No.: 525,944

[52] U.S. Cl. ..... 292/169.13; 70/143

[51] Int. Cl.[2] ..... E05C 1/12

[58] Field of Search ..... 70/143; 292/42, 169.13, 292/169.19, 175, DIG. 44

[56] References Cited

UNITED STATES PATENTS

| | | | |
|---|---|---|---|
| 1,220,939 | 3/1917 | Bock | 70/143 |
| 3,353,858 | 11/1967 | Neary | 292/169.13 X |
| 3,586,361 | 6/1971 | Ohno | 70/143 X |
| 3,666,306 | 5/1972 | Genakis | 70/143 X |

*Primary Examiner*—Robert L. Wolfe

*Attorney, Agent, or Firm*—Edward J. Biskup

[57] ABSTRACT

A latch mechanism for a closure member that has a lever arrangement for connecting a main bolt to an auxiliary bolt. The two bolts are retractable together against the bias of a spring which acts through the lever arrangement to provide increased extension of the main bolt when the auxiliary bolt is maintained in a retracted position.

2 Claims, 6 Drawing Figures

LATCH MECHANISM FOR CLOSURE MEMBER

This invention concerns a door latch and more particularly a latch mechanism for use with doors that are relatively narrow and light in weight and that require a minimum amount of force to cause the door to be moved to a closed position.

In the preferred form the latching mechanism according to the invention is adapted to be mounted on a door that is supported for movement between an open position wherein the door is spaced from a fixed strike plate, and a closed position wherein the door is located adjacent the strike plate. The latching mechanism includes a housing which slidably supports a main bolt and an auxiliary bolt with the main bolt being adapted to assume three positions; namely, a retracted position wherein the outer end of the bolt is located substantially at the outer edge of the housing, a normally extended position wherein the outer end of the bolt is located outwardly beyond the edge of the housing a predetermined distance, and a fully extended position wherein the outer end of the bolt is located outwardly beyond the edge of the housing a distance greater than the predetermined distance. The auxiliary bolt is adapted to assume two positions; namely, a normally extended position wherein the outer end of the auxiliary bolt extends out of the housing a distance substantially equal to the aforementioned predetermined distance, and a retracted position wherein the outer end of the auxiliary bolt is located substantially at the edge of the housing. The housing also supports an actuator and a lever which are biased by spring means in opposite directions and which cooperate with and interconnect the inner ends of the main and auxiliary bolts for maintaining both bolts in the normally extended positions when the door is in the open position and for causing the main bolt to be moved to the fully extended position into the opening in the strike plate when the door is in the closed position.

The objects of the present invention are to provide an improved latch mechanism for a closure member that has a bolt which normally extends out of a housing a predetermined distance when the closure member is in an open position and that extends out of the housing into a strike plate a distance greater than said predetermined distance when the closure member is in the closed position; to provide an improved latch mechanism for a closure member that has a main bolt and an auxiliary bolt that normally extend out of a housing a predetermined distance and in which both bolts are movable into the housing against the bias of a spring to store energy which subsequently acts through a lever arrangement to extend the main bolt into a strike plate a distance greater than the predetermined distance; to provide an improved latch mechanism for a closure member that has a main bolt and an auxiliary bolt that are retractable together into a latch housing against a spring means which acts through an actuator and lever to increase the outward displacement of the main bolt when the auxiliary bolt only is maintained in the retracted position; and to provide an improved actuator and lever arrangement in a latch mechanism for connecting a main bolt to an auxiliary bolt so that the latter acts in response to a spring force to provide an amplified extension of the main bolt that results in a more positive latching system.

Other objects and advantages of the present invention will be apparent from the following detailed description when taken with the drawings in which.

Figure 1:
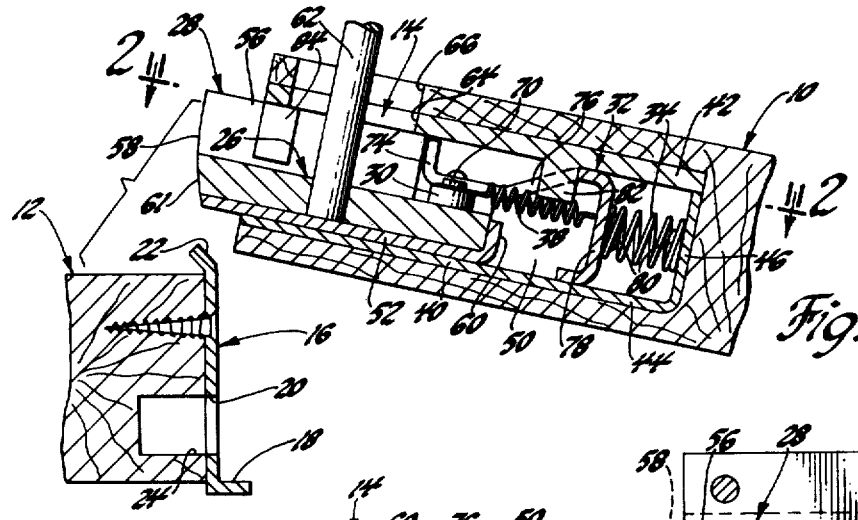
FIG. 1 is a sectional view showing the latch mechanism according to the invention mounted within a door that is positioned in an open position relative to a fixed strike plate.
Figure 2:
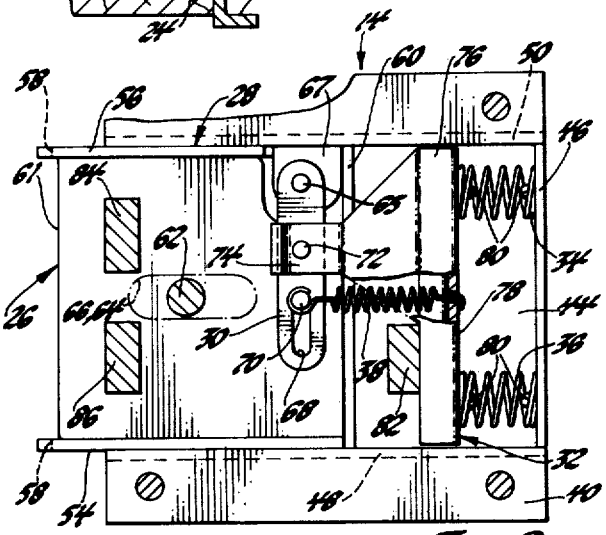
FIG. 2 is a view taken on lines 2—2 of FIG. 1.

Referring to the drawings and more particular FIG. 1 and 2 thereof, a cross-sectional view of a hinged vertically oriented door or closure member 10 is shown with the door 10 assuming an open position relative to a door frame 12 and incorporating a latch mechanism 14 made in accordance with the invention. The door frame 12 has a strike plate 16 fixed thereto that is formed with a stop 18 for the door 10, an elongated vertical opening 20 for a bolt, and the usual camming surface 22. As is conventional, a cavity 24 for accommodating a bolt is formed in the door frame 12 that registers with the opening 20 formed in the strike plate.

The latch mechanism 14 comprises a main bolt 26, an auxiliary bolt 28, and a lever arrangement which, as seen in FIG. 2 includes a link 30 and an actuator member 32. All of the aforementioned elements together with a pair of compression springs 34 and 36 and a tension spring 38 are located within a housing having parallel side walls 42 and 44, and end wall 46, and upper and lower walls 48 and 50.

The auxiliary bolt 28 is supported in the housing 40 for sliding movement and is generally U-shaped in cross section consisting of a vertical base plate 52 with integrally formed legs 54 and 56 each of which is of the same thickness as the base plate. Each of the legs 54 and 56 is parallel to the other leg and lies in a horizontal plane which is perpendicular to the plane of the base plate 52. The outer end of each of the legs 54 and 56 terminates with a curved outer surface 58 while the inner end of the base plate 52 is formed with a flange 60 located in a vertical plane which is perpendicular to the plane of the base plate. As seen in FIG. 1, each of the legs 54 and 56 of the auxiliary bolt 28 is of a width which is substantially greater than the width of the opening 20 in strike plate 16 and substantially equal to the transverse distance between the side walls 42 and 44 while allowing relative movement of the bolt.

As seen in FIG. 2, the main bolt 26 is generally square in configuration and is located within the confines of the legs 54 and 56, the base plate 52, and the flange 60 formed with the auxiliary bolt 28. The main bolt 26 is rectangular in vertical-section and is sized so it can enter the opening 20 when the door 10 is in the closed position. The outer end of the bolt is formed with a curved surface 61 which merges with and has the same configuration as the surface 58 while the inner end of the main bolt normally contacts the flange 60. A rod 62 is centrally fixed to the main bolt 26 and extends outwardly through horizontally elongated and identical slots 64 and 66 formed respectively within the side wall 42 of the housing and in the door 10. The rod 62 serves as a handle which permits the main bolt 26 to be slidably moved into a retracted position in a manner which will hereinafter be described. Thus, from the above description, it should be apparent that both the auxiliary bolt 28 and the main bolt 26 are slidably supported within the housing 40 with the main bolt 26 being located along side the auxiliary bolt 28 and being movable relative to the auxiliary bolt against the bias of spring 38 in an outward direction or to the left as seen in FIG. 2. On the other hand, when the main bolt 26 is moved in an inward direction or towards the right as seen in FIG. 1, the inner end of the main bolt engages the flange 60 causing the auxiliary bolt 28 and the main bolt to move together to compress the compression springs 34 and 36.

Figure 6:
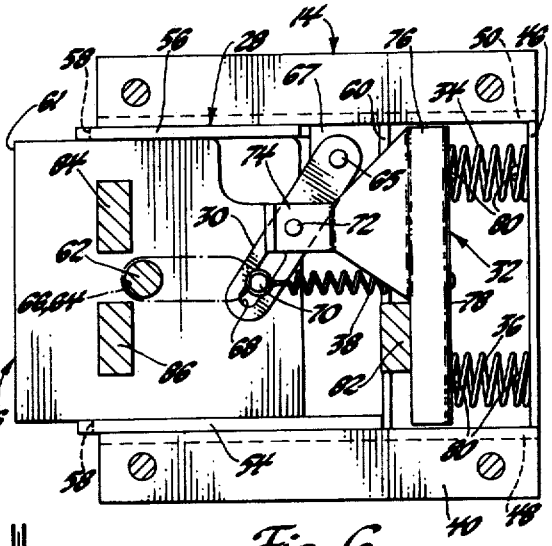
FIG. 6 is a view taken on line 6—6 of FIG. 5.

In this regard, it will be noted that the link 30 has one end thereof connected by a pivotal connection 65 to a tab 67 which is offset in a vertical plane from and rigidly fixed with a corner of the base plate 52 of the auxiliary bolt 28 as seen in FIG. 2. The other end of the link 30 is formed with an elongated slot 68 which slidably accommodates a pin 70 that is rigid with the main bolt 26. An intermediate portion of the link 30 adjacent the pivotal connection 65 is pivotally connected by a pivotal connection 72 to a projection 74 formed with the actuator member 32. Although not shown, the pivotal connection 72 is slidably located in an elongated slot formed in the link 30 so as to permit the actuator to move between the positions of FIG. 4 and FIG. 6.

The actuator member 32, as seen in FIG. 1, is generally S-shaped in cross section, and has the projection 74 integrally formed with a diverging section 76 which merges with a base section 78 that extends between the upper and lower walls 48 and 50 and also the side walls 42 and 44 of the housing. The tension spring 38 has one end thereof wound about the pin 70 while the other end is fixed with a central portion of the base section 78 of the actuator member 32. The tension spring continually draws the pin 70 towards the base section 78.

As seen in FIG. 2, both the base section 78 of the actuator member and the back wall 46 of the housing 40 are formed with axially aligned protrusions 80 which serve to center and maintain the compression springs 34 and 36 in position. It will also be noted that the side wall 42 includes an integral stop member 82 which limits movement of the actuator member 32 in an outward direction or to the left as seen in FIG. 1. The side wall 42 also has a pair of outwardly extending and integrally formed guide members 84 and 86 which aid in maintaining the bolts in proper positions within the housing 40.

Figure 4:
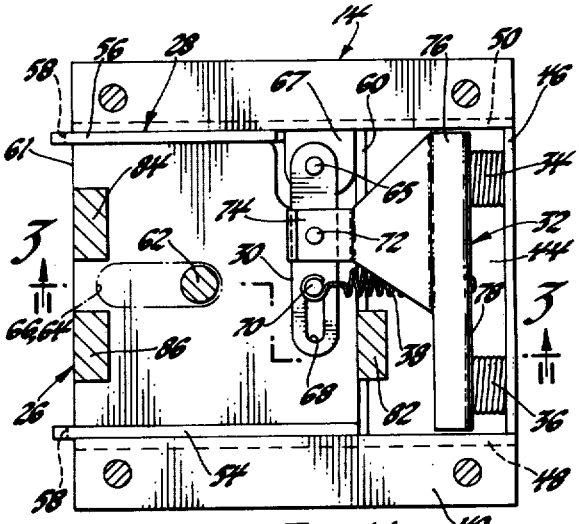
FIG. 4 is a view taken on lines 4—4 of FIG. 3.
Figure 3:
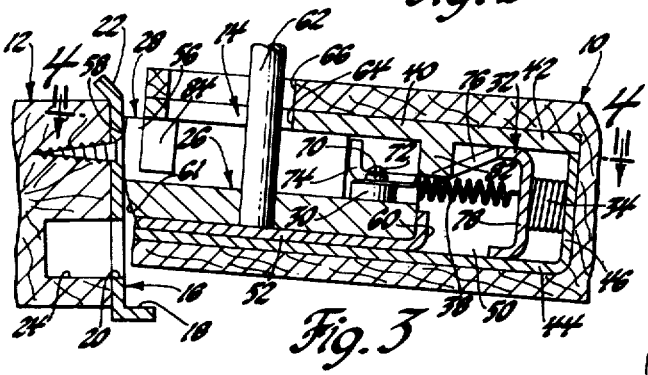
FIG. 3 is a view similar to FIG. 1 but shows the door in the partially closed position with the main bolt and the auxiliary bolt of the latch mechanism located in the retracted position.

The operation of the latch mechanism 14 described above is as follows:

As seen in FIGS. 1 and 2, both the main and auxiliary bolts 26 and 28 are located in a normally extended position and the door 10 is in the open position. At such time, the compression springs 34 and 36 urge the actuator member 32 outwardly as limited by the stop member 82 while the tension spring 38 maintains the link 30 in an upright position with the pivotal connections 64, 70 and 72 vertically aligned thereby causing the outer ends 58 and 61 of the main and auxiliary bolts to be aligned and form a single bolt located a predetermined distance outwardly relative to the outer edge of the housing 40. When the door 10 is partially closed as seen in FIG. 3, the main and auxiliary bolts 26 and 28 are cammed into a retracted position by the surface 22 of strike plate 16 and act through the link 30 and the pivotal connection 72 to move the actuator member 32 inwardly or towards the right as seen in FIG. 3 and 4. Such movement of the actuator member 32 does not affect the tension spring 38, however, it causes the springs 34 and 36 to be compressed. Subsequently, the door 10 moves into the fully closed position as limited by the stop 18 of the strike plate 16 shown in FIG. 5. At such time, the outer surface 58 of the auxiliary bolt 28 continues to maintain contact with the strike plate 16 and thereby causes the bolt 28 to stay in the retracted position. The main bolt 26, however, is axially aligned with the opening 20 in the strike plate 16 and moves outwardly into the opening 20 a distance greater than the aforementioned predetermined distance maintained by the main bolt when the door 10 is in the open position. This occurs because the stored energy in the compressed springs 34 and 36 as seen in FIG. 4 is now released and acts through the actuator member 32 to apply an outward force on the link 30 causing the latter to pivot clockwise about its pivotal connection 64 and move the pin 70 and, accordingly, the main bolt 26 towards the left thereby extending the bolt 26 to the fully extended position of FIGS. 5 and 6. It will be noted that spring force provided by the compressed springs 34 and 36 during the partial closing movement of the door 10 is of a magnitude greater than the strength of the tension spring 38. Thus, the tension spring 38 does not prevent the outward movement of the main bolt 26. Moreover, the pivotal connection 72 is located near to the pivotal connection 64 so as to provide an increased displacement of the lower portion of the link 30 and accordingly an amplified movement of the pin 70 and main bolt 26.

Figure 5:
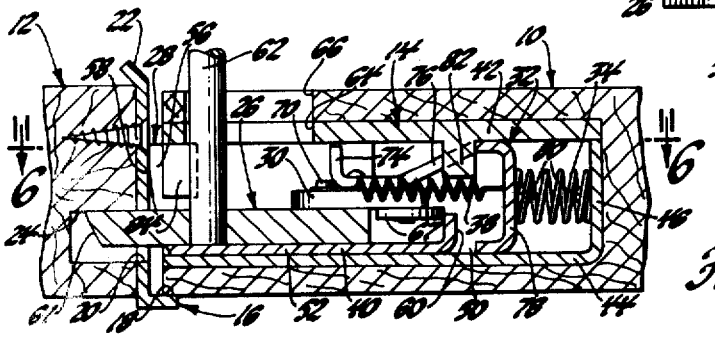
FIG. 5 is a view similar to FIG. 1 but shows the door in the fully closed position with the auxiliary bolt in the retracted position and the main bolt located in the fully extended position.

Thus, from the above description it should be apparent that when both the auxiliary and main bolts 26 and 28 are moved into the housing 50, the springs 34 and 36 are compressed and subsequently dissipate the stored energy by acting through the link 30 to move the main bolt 28 outwardly relative to the housing 40. The increased displacement of the main bolt 28 results in a more positive lock without requiring higher closing forces of the door 10 and thereby is particularly adapted for use with light doors. As should be apparent, after the door 10 is closed, the bolt 28 can be retracted from the opening 20 in the strike plate 16, as shown in FIG. 5, by moving the rod 62 manually to the right followed by movement of the door to the position of FIG. 1. After the rod 62 is released and the door 10 is opened, the various elements of the latch mechanism 14 will again assume the normally extended position of FIGS. 1 and 2.

Various changes and modifications can be made in this construction without departing from the spirit of the invention. Such changes and modifications are contemplated by the inventor and he does not wish to be limited except by the scope of the appended claims.

I claim:

1. A latch mechanism for a closure member that is supported for movement between an open position wherein said closure member is spaced from a fixed strike plate having an opening formed therein and a closed position wherein said closure member is located adjacent said strike plate, said latch mechanism comprising a housing having an outer edge, a main bolt slidably supported in said housing, said main bolt having an outer end and an inner end and being adapted to be located in a retracted position wherein the outer end of the bolt is positioned substantially at the outer edge of the housing, and a normally extended position wherein the outer end of said main bolt is located outwardly beyond the outer edge of the housing a predetermined distance, and a fully extended position wherein the outer end of the bolt is located outwardly beyond the outer edge a distance greater than said predetermined distance, an auxiliary bolt having a pair of legs formed therewith and being slidably supported in said housing along side said main bolt, said auxiliary bolt having an outer end adapted to assume, a normally extended position wherein said outer end of the auxiliary bolt extends out of said housing a distance substantially equal to said predetermined distance and a retracted position wherein said outer end of the auxiliary bolt is located substantially at said outer edge of said housing, said outer end of the auxiliary bolt adapted to contact said strike plate and be moved into and be maintained in its retracted position when said closure member is in said closed position, an elongated link, an actuator member, a first pivot connection for connecting one end of said link to said auxiliary bolt, a second pivot connection for connecting the acutator member to said link adjacent to said first pivot connection, a lost motion connection for connecting the other end of said link to said main bolt, a tension spring extending between said main bolt and said actuator member, and a compression spring normally biasing said actuator member outwardly from said housing for maintaining the main bolt and the auxiliary bolt in said normally extended position when said closure member is in said open position and for causing the main bolt to be extended by said link to said fully extended position into the opening in said strike plate when said closure member is in said closed position.

2. A latch mechanism for a closure member that is supported for movement between an open position wherein said closure member is spaced from a fixed strike plate having an opening formed therein and a closed position wherein said closure member is located adjacent said strike plate, said latch mechanism comprising a housing having an outer edge, a main bolt slidably supported in said housing, said main bolt having an outer end and an inner end and being adapted to be located in a retracted position wherein the outer end of the bolt is positioned substantially at the outer edge of the housing, and a normally extended position wherein the outer end of said main bolt is located outwardly beyond the outer edge of the housing a predetermined distance, and a fully extended position wherein the outer end of the bolt is located outwardly beyond the outer edge a distance greater than said predetermined distance, an auxiliary bolt slidably supported in said housing along side said main bolt, said auxiliary bolt having an outer end adapted to assume a normally extended position wherein said outer end of the auxiliary bolt extends out of said housing a distance substantially equal to said predetermined distance and a retracted position wherein said outer end of the auxiliary bolt is located substantially at said outer edge of said housing, said outer end of the auxiliary bolt adapted to contact said strike plate and be moved into and be maintained in its retracted position when said closure member is in said closed position, a link, an actuator member, a first pivot connection for connecting a first portion of said link to said auxiliary bolt, a second pivot connection for connecting the actuator member to said link adjacent to said first pivot connection, a lost motion connection for connecting a second portion of said link to said main bolt, a tension spring extending between said main bolt and said actuator member, and a compression spring normally biasing said actuator member outwardly from said housing for maintaining the main bolt and the auxiliary bolt in said normally extended position when said closure member is in said open position and for causing the main bolt to be extended by said link to said fully extended position into the opening in said strike plate when said closure member is in said closed position.

* * * * *